US010765922B2

(12) United States Patent
Morales et al.

(10) Patent No.: US 10,765,922 B2
(45) **Date of Patent: *Sep. 8, 2020**

(54) MIXED MATERIAL GOLF CLUB HEAD

(71) Applicant: KARSTEN MANUFACTURING CORPORATION, Phoenix, AZ (US)

(72) Inventors: Eric J. Morales, Laveen, AZ (US); Ryan M. Stokke, Anthem, AZ (US); Martin R. Jertson, Phoenix, AZ (US); Tyler A. Shaw, Paradise Valley, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/380,873

(22) Filed: Apr. 10, 2019

(65) Prior Publication Data

US 2019/0232128 A1 Aug. 1, 2019

Related U.S. Application Data

(63) Continuation of application No. 15/901,081, filed on Feb. 21, 2018, now Pat. No. 10,300,354, which is a (Continued)

(51) Int. Cl.
*A63B 53/04* (2015.01)
*A63B 60/02* (2015.01)
*A63B 60/00* (2015.01)

(52) U.S. Cl.
CPC ..... *A63B 53/0475* (2013.01); *A63B 53/0466* (2013.01); *A63B 60/02* (2015.10); (Continued)

(58) Field of Classification Search
CPC . A63B 53/0475; A63B 53/0466; A63B 60/02; A63B 2209/00; A63B 2053/0491; (Continued)

(56) References Cited

U.S. PATENT DOCUMENTS 4,581,190 A 4/1986 Nagamoto et al.
4,664,383 A 5/1987 Aizawa
(Continued)

FOREIGN PATENT DOCUMENTS

JP 2004024734 1/2004
JP 2006271770 10/2006
(Continued)

OTHER PUBLICATIONS

E9 Face Technology With Dual Roll—Multi-material Construction, Cobra Golf, accessed Oct. 19, 2017; https:/Iwww.cobragolf.com/pumagolf/tech—overview.
(Continued)

*Primary Examiner* — Sebastiano Passaniti

(57) ABSTRACT

A golf club head includes a metallic front body coupled with a rear body to define a substantially hollow structure. The metallic front body includes a strike face and a surrounding frame that extends rearward from a perimeter of the strike face. The rear body includes a crown member and a sole member coupled to the crown member. The sole member comprises a structural layer formed from a filled thermoplastic material and a fiber reinforced composite resilient layer bonded to an external surface of the structural layer. The structural layer includes a plurality of apertures extending through a thickness of the structural layer, and the resilient layer extends across each of the plurality of apertures. The structural layer and the resilient layer each include a common thermoplastic resin component, and are directly bonded to each other without an intermediate adhesive.

20 Claims, 8 Drawing Sheets

Related U.S. Application Data continuation of application No. 15/607,166, filed on May 26, 2017, now Pat. No. 9,925,432.

(60) Provisional application No. 62/342,741, filed on May 27, 2016.

(52) U.S. Cl.
CPC ..... *A63B 53/04* (2013.01); *A63B 53/047* (2013.01); *A63B 2053/042* (2013.01); *A63B 2053/045* (2013.01); *A63B 2053/0416* (2013.01); *A63B 2053/0433* (2013.01); *A63B 2053/0437* (2013.01); *A63B 2053/0491* (2013.01); *A63B 2060/002* (2015.10); *A63B 2209/00* (2013.01); *A63B 2209/02* (2013.01)

(58) Field of Classification Search
CPC ..... A63B 2060/002; A63B 2053/045; A63B 53/04; A63B 53/047; A63B 2053/0416; A63B 2053/042; A63B 2053/0433; A63B 2053/0437; A63B 2209/02
USPC ..... 473/324–350, 287–292
See application file for complete search history.

(56) References Cited

U.S. PATENT DOCUMENTS 5,080,366 A 1/1992 Okumoto et al.
5,193,811 A 3/1993 Okumoto et al.
5,328,176 A 7/1994 Lo
5,586,949 A 12/1996 Aizawa
5,614,143 A 3/1997 Hager
5,624,331 A 4/1997 Lo et al.
5,669,827 A 9/1997 Nagamoto
6,354,963 B1 3/2002 Kodama et al.
6,471,604 B2 10/2002 Hocknell et al.
6,491,592 B2 12/2002 Cackett et al.
6,565,452 B2 5/2003 Helmstetter et al.
6,582,323 B2 6/2003 Soracco et al.
6,602,149 B1 8/2003 Jacobson et al.
6,648,774 B1 11/2003 Lee
6,663,504 B2 12/2003 Hocknell et al.
6,739,982 B2 5/2004 Murphy et al.
6,739,983 B2 5/2004 Helmstetter et al.
6,758,763 B2 7/2004 Murphy et al.
6,860,823 B2 3/2005 Lee
6,926,619 B2 8/2005 Helmstetter et al.
6,929,565 B2 8/2005 Nakahara et al.
6,994,637 B2 2/2006 Murphy et al.
7,025,692 B2 4/2006 Erickson et al.
7,066,835 B2 6/2006 Evans
7,108,614 B2 9/2006 Lo
7,118,493 B2 10/2006 Galloway
7,121,955 B2 10/2006 Stevens et al.
7,121,957 B2 10/2006 Hocknell et al.
7,128,661 B2 10/2006 Soracco et al.
7,137,907 B2 11/2006 Gibbs
7,144,333 B2 12/2006 Murphy et al.
7,147,576 B2 12/2006 Imamoto et al.
7,163,470 B2 1/2007 Galloway et al.
7,169,060 B2 1/2007 Stevens et al.
7,175,541 B2 2/2007 Lo
7,252,600 B2 8/2007 Murphy et al.
7,255,654 B2 8/2007 Murphy et al.
7,258,624 B2 8/2007 Kobayashi
7,258,625 B2 8/2007 Kawaguchi et al.
7,261,645 B2 8/2007 Oyama
7,278,927 B2 10/2007 Gibbs et al.
7,303,487 B2 * 12/2007 Kumamoto ..... A63B 53/0466 473/345
7,311,613 B2 12/2007 Stevens et al.
7,318,782 B2 1/2008 Imamoto et al.
7,320,646 B2 1/2008 Galloway
7,338,390 B2 3/2008 Lindsay
7,344,452 B2 3/2008 Imamoto et al.
7,367,900 B2 5/2008 Kumamoto
7,387,577 B2 6/2008 Murphy et al.
7,402,112 B2 7/2008 Galloway
7,407,448 B2 8/2008 Stevens et al.
7,438,647 B1 10/2008 Hocknell
7,438,649 B2 10/2008 Ezaki et al.
7,448,964 B2 11/2008 Schweigert et al.
7,455,600 B2 11/2008 Imamoto et al.
7,468,005 B2 12/2008 Kouno
7,488,261 B2 2/2009 Cackett et al.
7,491,134 B2 2/2009 Murphy et al.
7,494,424 B2 2/2009 Williams et al.
7,497,788 B2 3/2009 Imamoto et al.
7,510,485 B2 3/2009 Yamamoto
7,520,822 B2 4/2009 Yamagishi et al.
7,530,901 B2 5/2009 Imamoto et al.
7,530,903 B2 5/2009 Imamoto et al.
7,540,812 B2 6/2009 Imamoto et al.
7,568,982 B2 8/2009 Cackett et al.
7,582,248 B2 9/2009 Reyes et al.
7,591,737 B2 9/2009 Gibbs et al.
7,601,078 B2 10/2009 Mergy et al.
7,607,992 B2 10/2009 Nishio
7,632,193 B2 12/2009 Thielen
7,658,686 B2 2/2010 Soracco
7,674,187 B2 3/2010 Cackett et al.
7,691,008 B2 4/2010 Oyama
7,708,652 B2 5/2010 Cackett et al.
7,749,096 B2 7/2010 Gibbs et al.
7,749,103 B2 7/2010 Nakano
7,775,903 B2 8/2010 Kawaguchi et al.
7,785,212 B2 8/2010 Lukasiewicz et al.
7,959,523 B2 6/2011 Rae et al.
7,993,216 B2 8/2011 Lee
8,025,591 B2 9/2011 Cruz et al.
8,197,358 B1 6/2012 Watson et al.
8,308,582 B2 11/2012 Tanimoto
8,376,876 B2 2/2013 Gibbs et al.
8,419,569 B2 4/2013 Bennett et al.
8,425,827 B2 4/2013 Lee
8,435,137 B2 5/2013 Hirano
8,460,123 B1 6/2013 DeMille et al.
8,491,416 B1 7/2013 DeMille et al.
8,506,421 B2 8/2013 Stites et al.
8,556,746 B1 10/2013 DeMille et al.
8,608,591 B2 12/2013 Chao
8,632,419 B2 1/2014 Tnag et al.
8,632,420 B2 1/2014 Kawaguchi et al.
8,696,489 B2 4/2014 Gibbs et al.
8,702,534 B2 4/2014 DeMille et al.
8,715,109 B2 5/2014 Bennett et al.
8,727,911 B2 5/2014 DeMille et al.
8,790,196 B2 7/2014 Solheim et al.
8,814,723 B2 8/2014 Tavares et al.
8,870,680 B2 10/2014 Yamamoto
8,870,683 B2 10/2014 Hettinger et al.
8,926,450 B2 1/2015 Takahashi et al.
8,979,671 B1 3/2015 DeMille et al.
9,174,098 B2 3/2015 Hayase
9,033,822 B1 5/2015 DeMille et al.
9,079,368 B2 7/2015 Tavares et al.
9,168,435 B1 10/2015 Boggs et al.
9,352,198 B2 5/2016 Roach et al.
9,393,465 B2 7/2016 Stokke et al.
9,399,157 B2 7/2016 Greensmith
9,427,631 B1 8/2016 Larson et al.
9,457,245 B2 10/2016 Lee
9,504,883 B2 11/2016 DeMille et al.
9,526,955 B2 12/2016 DeMille et al.
9,579,548 B2 2/2017 Boyd et al.
9,682,291 B2 6/2017 Chao
9,682,299 B2 6/2017 Tang et al.
9,724,573 B2 8/2017 Kawaguchi et al.
9,833,666 B2 12/2017 Boggs et al.
9,861,866 B2 1/2018 DeMille et al.
9,908,014 B1 3/2018 Wester
9,925,432 B2 * 3/2018 Morales ..... A63B 53/0475
10,046,212 B2 8/2018 Sargent et al.

(56) References Cited

U.S. PATENT DOCUMENTS

| | | | | |
|---|---|---|---|---|
| 10,300,354 | B2 * | 5/2019 | Morales | A63B 53/0475 |
| 2003/0186760 | A1 | 10/2003 | Lee | |
| 2004/0033844 | A1 | 2/2004 | Chen | |
| 2004/0116207 | A1 | 6/2004 | Shiell et al. | |
| 2005/0026719 | A1 | 2/2005 | Yang | |
| 2005/0043115 | A1 | 2/2005 | Lin | |
| 2005/0143189 | A1 | 6/2005 | Lai et al. | |
| 2005/0159239 | A1 | 7/2005 | Imamoto et al. | |
| 2005/0233831 | A1 | 10/2005 | Ezaki et al. | |
| 2006/0052181 | A1 | 3/2006 | Serrano et al. | |
| 2007/0155533 | A1 | 7/2007 | Solheim et al. | |
| 2008/0293512 | A1 | 11/2008 | Chen | |
| 2016/0332040 | A1 | 11/2016 | Lafortune et al. | |

FOREIGN PATENT DOCUMENTS

| | | |
|---|---|---|
| JP | 2013009713 | 1/2013 |
| WO | 2007076304 | 7/2007 |
| WO | 2017205699 | 5/2016 |

OTHER PUBLICATIONS

Taylormade M1 Driver, Multi-material Construction, accessed Jun. 7, 2016; http://www.intheholegolf.com/TM15-M1D/TaylorMade-M1-Driver.html.

Adams Men's Golf Speedline Super XTD Fairway Wood; Amazon, accessed Oct. 19, 2017; https://www.amazon.com/Adams-Golf-Speedline-SUPER-Fairway/dp/B007LI2S04.

Callaway Womens Great Big Bertha Driver, Amazon, accessed Oct. 19, 2017; https://www.amazon.com/Callaway-Womens-Great-Bertha-Driver/dp/B013SYR0VQ.

Nike Vapor Flex 440 Driver Adjustable Loft Golf Club Left Hand, accessed Jun. 7, 2016; http://www.globalgolf.com/golf-clubs/1034365-nike-vapor-flex-440-driver-left-hand/.

International Search Report and Written Opinion of the International Searching Authority from PCT Application No. PCT/US19/14321, dated May 9, 2019.

International Search Report and Written Opinion of the International Searching Authority from PCT Application No. PCT/US19/14326, dated May 23, 2019.

International Search Report and Written Opinion of the International Searching Authority from PCT Application No. PCT/US17/034807, dated Aug. 2, 2017.

* cited by examiner

MIXED MATERIAL GOLF CLUB HEAD

CROSS REFERENCE TO RELATED APPLICATIONS

This is a continuation of U.S. patent application Ser. No. 15/901,081, filed Feb. 21, 2018, which is a continuation of U.S. patent application Ser. No. 15/607,166, now U.S. Pat. No. 9,925,432, filed May 26, 2017, which claims the benefit of priority from U.S. Provisional Patent Application No. 62/342,741, filed 27 May 2016, which is hereby incorporated by reference in its entirety.

TECHNICAL FIELD

The present invention relates generally to a golf club head with a mixed material construction.

BACKGROUND

In an ideal club design, for a constant total swing weight, the amount of structural mass would be minimized (without sacrificing resiliency) to provide a designer with additional discretionary mass to specifically place in an effort to customize club performance. In general, the total of all club head mass is the sum of the total amount of structural mass and the total amount of discretionary mass. Structural mass generally refers to the mass of the materials that are required to provide the club head with the structural resilience needed to withstand repeated impacts. Structural mass is highly design-dependent, and provides a designer with a relatively low amount of control over specific mass distribution. Conversely, discretionary mass is any additional mass (beyond the minimum structural requirements) that may be added to the club head design for the sole purpose of customizing the performance and/or forgiveness of the club. There is a need in the art for alternative designs to all metal golf club heads to provide a means for maximizing discretionary weight to maximize club head moment of inertia (MOI) and lower/back center of gravity (COG).

While this provided background description attempts to clearly explain certain club-related terminology, it is meant to be illustrative and not limiting. Custom within the industry, rules set by golf organizations such as the United States Golf Association (USGA) or The R&A, and naming convention may augment this description of terminology without departing from the scope of the present application.

DETAILED DESCRIPTION

Figure 1:
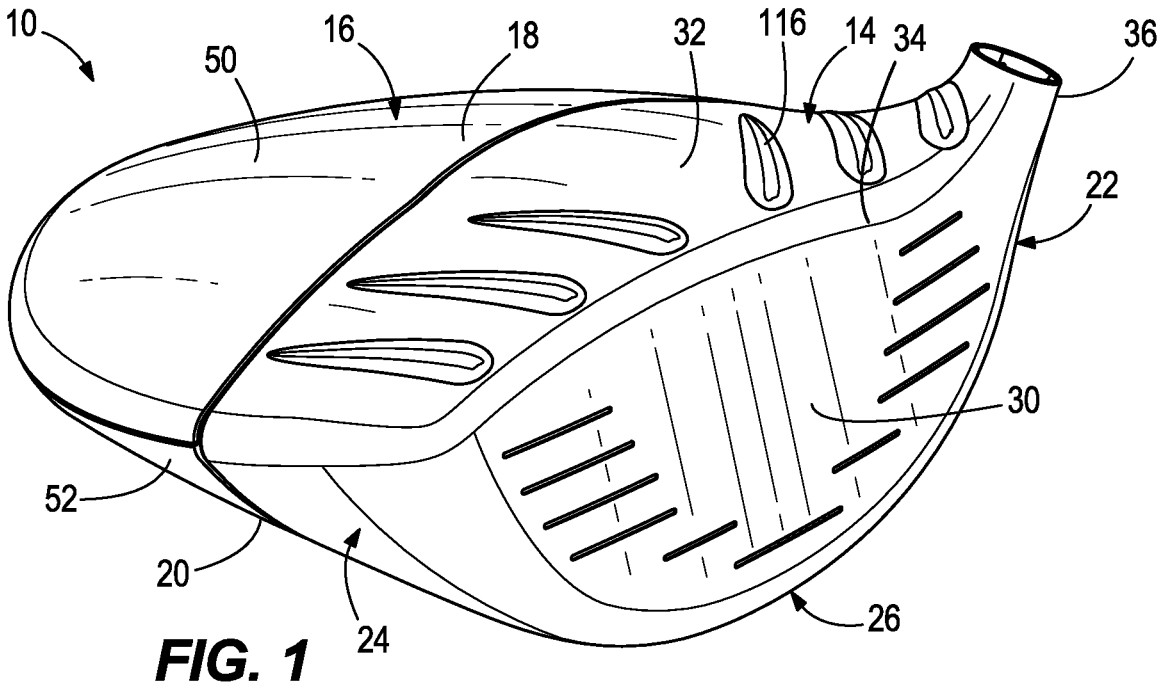
FIG. 1 is a schematic perspective view of a mixed-material golf club head.

The present embodiments discussed below are directed to a club head that utilizes a mixed material rear body construction in combination with metallic strikeface and front frame structure. The mixed material rear body is comprised of a fiber reinforced thermoplastic composite resilient layer and a molded thermoplastic structural layer. Utilizing a mixed material rear body construction provides a significant reduction in structural weight while not sacrificing any design flexibility.

A further advantage of the mixed material rear body embodiments described below is the manufacturer has the ability to provide robust means for reintroducing discretionary mass. While such designs may be formed entirely from a filled thermoplastic, such as polyphenylene sulfide (PPS), the use of a fiber reinforced composite provides a stronger and lighter construction across a continuous outer surface. Further, the molded resilient layer further comprises a filled thermoplastic resin. Having thermoplastic resins in both the fiber reinforced thermoplastic composite resilient layer and the molded thermoplastic structural layer provide an ability to co-mold these materials. This provides a club head design of unique geometries for weight savings via the thermoplastic structural layer, but also manufacturing capability of merging layers of rigid strength via the composite resilient layer. Overall, the merging of these mixed material rear constructions with the metallic strikeface and front frame structure facilitate the transfer of dynamic impact loads from the weight/weighted portion to the metallic front of the club head.

Further, the use of thermoplastic resins may provide certain acoustic advantages that are not possible with other polymers. Use of the thermoplastic polymers of the present construction enable the assembled golf club head to acoustically respond closer to that of an all-metal design.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "loft" or "loft angle" of a golf club, as described herein, refers to the angle formed between the club face and the shaft, as measured by any suitable loft and lie machine.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes with general reference to a golf club held at address on a horizontal ground plane and at predefined loft and lie angles, though are not necessarily intended to describe permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Referring to the drawings, wherein like reference numerals are used to identify like or identical components in the various views, FIG. 1 schematically illustrates a perspective view of a golf club head 10. In particular, the present technology relates to the design of a wood-style head, such as a driver, fairway wood, or hybrid iron.

The golf club head 10 includes a front body portion 14 ("front body 14") and a rear body portion 16 ("rear body 16") that are secured together to define a substantially closed/hollow interior volume. As is conventional with wood-style heads, the golf club head 10 includes a crown 18 and a sole 20, and may be generally divided into a heel portion 22, a toe portion 24, and a central portion 26 that is located between the heel portion 22 and toe portion 24.

The front body 14 generally includes a strike face 30 intended to impact a golf ball, a frame 32 that surrounds and extends rearward from a perimeter 34 of the strike face 30 to provide the front body 14 with a cup-shaped appearance, and a hosel 36 for receiving a golf club shaft or shaft adapter. To withstand the impact stresses that occur when the club head 10 strikes a golf ball, the front body 14 is formed from a metal or metal alloy, and preferably a light-weight metal alloy, such as, for example, a stainless steel or steel alloy (e.g., C300, C350, Ni (Nickel)-Co(Cobalt)-Cr(Chromium)-Steel Alloy, 565 Steel, AISI type 304 or AISI type 630 stainless steel), a titanium alloy (e.g., a Ti-6-4, Ti-3-8-6-4-4, Ti-10-2-3, Ti 15-3-3-3, Ti 15-5-3, Ti185, Ti 6-6-2, Ti-7s, Ti-92, or Ti-8-1-1 Titanium alloy), an amorphous metal alloy, or other similar materials.

To reduce the structural mass of the club head beyond what is possible with traditional metal forming techniques, the rear body 16 may be substantially formed from one or more polymeric materials and/or fiber reinforced polymeric composites. The structural weight savings accomplished through this design may be used to either reduce the entire weight of the club head 10 (which may provide faster club head speeds and/or longer hitting distances) or to increase the amount of discretionary mass that is available for placement on the club head 10 (i.e., for a constant club head weight). In a preferred embodiment, the additional discretionary mass is re-included in the final club head design via one or more metallic weights 40 that are coupled with the sole 20 and/or rear-most portion of the club head 10.

Figure 3:
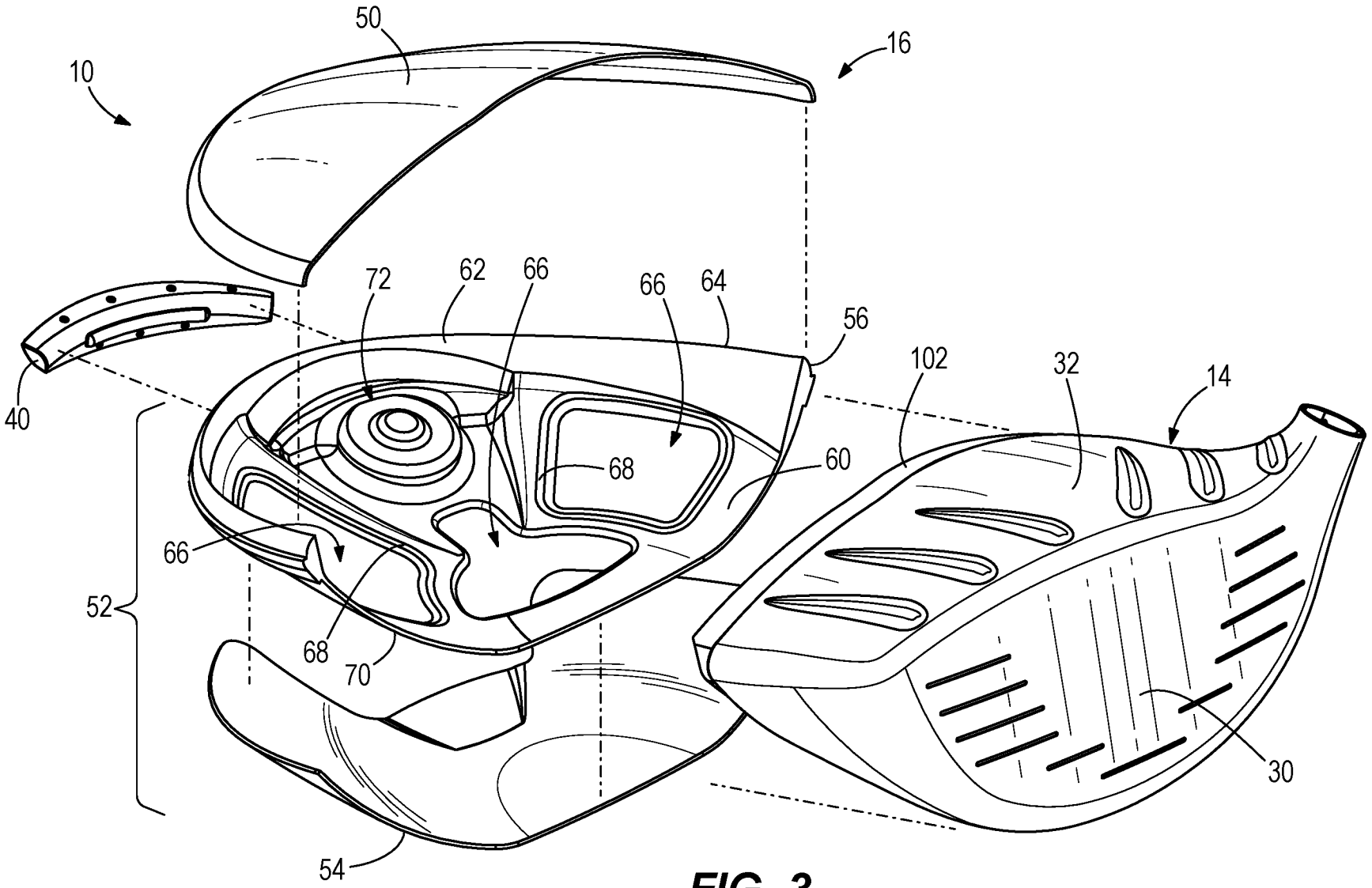
FIG. 3 is a schematic exploded perspective view of an embodiment of a mixed-material golf club head similar to that shown in FIG. 1.

Referring to FIG. 3, the rear body 16 may generally be formed by bonding a crown member 50 to a sole member 52. In a preferred embodiment, the crown member 50 forms a portion of the crown 18, the sole member 52 forms a portion of the sole 20, and they generally meet at an external seam that is at or slightly below where the tangent of the club head surface exists in a vertical plane (i.e., when the club head 10 is held in a neutral hitting position according to predetermined loft and lie angles).

In the present design, the rear body 16 may include a mix of molded thermoplastic materials (e.g., injection molded thermoplastic materials) and fiber reinforced thermoplastic composite materials. As used herein, a molded thermoplastic material is one that relies on the polymer itself to provide structure and rigidity to the final component. The molded thermoplastic material is one that is readily adapted to molding techniques such as injection molding, whereby the material is freely flowable when in a heated to a temperature above the melting point of the polymer. A molded thermoplastic material with a mixed-in filler material is referred to as a filled thermoplastic (FT) material. Filled thermoplastic materials are freely flowable when in a heated/melted state. To facilitate the flowable characteristic, filler materials generally include discrete particulate having a maximum dimension of less than about 25 mm, or more commonly less than about 12 mm. For example, the filler materials can include discrete particulate having a maximum dimension of 4 mm, 5 mm, 6 mm, 7 mm, 8 mm, 9 mm, or 10 mm. Filler materials useful for the present designs may include, for example, glass beads or discontinuous reinforcing fibers formed from carbon, glass, or an aramid polymer.

In contrast to molded and filled thermoplastic materials, fiber reinforced composite (FRC) materials generally include one or more layers of a uni- or multi-directional fiber fabric that extend across a larger portion of the polymer. Unlike the reinforcing fibers that may be used in FT materials, the maximum dimension of fibers used in FRCs may be substantially larger/longer than those used in FT materials, and may have sufficient size and characteristics such that they may be provided as a continuous fabric separate from the polymer. When formed with a thermoplastic polymer, even if the polymer is freely flowable when melted, the included continuous fibers are generally not.

FRC materials are generally formed by arranging the fiber into a desired arrangement, and then impregnating the fiber material with a sufficient amount of a polymeric material to provide rigidity. In this manner, while FT materials may have a resin content of greater than about 45% by volume or more preferably greater than about 55% by volume, FRC materials desirably have a resin content of less than about 45% by volume, or more preferably less than about 35% by volume. FRC materials traditionally use two-part thermoset epoxies as the polymeric matrix, however, it is possible to also use thermoplastic polymers as the matrix. In many instances, FRC materials are pre-prepared prior to final manufacturing, and such intermediate material is often referred to as a prepreg. When a thermoset polymer is used, the prepreg is partially cured in intermediate form, and final curing occurs once the prepreg is formed into the final shape. When a thermoplastic polymer is used, the prepreg may include a cooled thermoplastic matrix that can subsequently be heated and molded into final shape.

With continued reference to FIG. 3, in an embodiment, the crown member 50 may be substantially formed from a formed fiber reinforced composite material that comprises a woven glass or carbon fiber reinforcing layer embedded in a polymeric matrix. In such an embodiment, the polymeric matrix is preferably a thermoplastic material such as, for example, polyphenylene sulfide (PPS), polyether ether ketone (PEEK), or a polyamide such as PA6 or PA66. In other embodiments, the crown member 50 may instead be formed from a filled thermoplastic material that comprises a glass bead or discontinuous glass, carbon, or aramid polymer fiber filler embedded throughout a thermoplastic material such as, for example, polyphenylene sulfide (PPS), polyether ether ketone (PEEK), or polyamide. In still other embodiments, such as described below with respect to FIGS. 9 and 10, the crown member 50 may have a mixed-material construction that includes both a filled thermoplastic material and a formed fiber reinforced composite material.

In the embodiment illustrated in FIG. 3, the sole member 52 has a mixed-material construction that includes both a fiber reinforced thermoplastic composite resilient layer 54 and a molded thermoplastic structural layer 56. In a preferred embodiment, the molded thermoplastic structural layer 56 may be formed from a filled thermoplastic material that comprises a glass bead or discontinuous glass, carbon, or aramid polymer fiber filler embedded throughout a thermoplastic material such as, for example, polyphenylene sulfide (PPS), polyether ether ketone (PEEK), or a polyamide such as PA6 or PA66. The resilient layer 54 may then comprise a woven glass, carbon fiber, or aramid polymer fiber reinforcing layer embedded in a thermoplastic polymeric matrix that includes, for example, a polyphenylene sulfide (PPS), a polyether ether ketone (PEEK), or a polyamide such as PA6 or PA66. In one particular embodiment, the crown member 50 and resilient layer may each comprise a woven carbon fiber fabric embedded in a polyphenylene sulfide (PPS), and the structural layer may comprise a filled polyphenylene sulfide (PPS) polymer.

With respect to both the polymeric construction of the crown member 50 and the sole member 52, any filled thermoplastics or fiber reinforced thermoplastic composites should preferably incorporate one or more engineering polymers that have sufficiently high material strengths and/or strength/weight ratio properties to withstand typical use while providing a weight savings benefit to the design. Specifically, it is important for the design and materials to efficiently withstand the stresses imparted during an impact between the strike face 30 and a golf ball, while not contributing substantially to the total weight of the golf club head 10. In general, preferred polymers may be characterized by a tensile strength at yield of greater than about 60 MPa (neat), and, when filled, may have a tensile strength at yield of greater than about 110 MPa, or more preferably greater than about 180 MPa, and even more preferably greater than about 220 MPa. In some embodiments, suitable filled thermoplastic polymers may have a tensile strength at yield of from about 60 MPa to about 350 MPa. In some embodiments, these polymers may have a density in the range of from about 1.15 to about 2.02 in either a filled or unfilled state, and may preferably have a melting temperature of greater than about 210° C. or more preferably greater than about 250° C.

PPS and PEEK are two exemplary thermoplastic polymers that meet the strength and weight requirements of the present design. Unlike many other polymers, however, the use of PPS or PEEK is further advantageous due to their unique acoustic properties. Specifically, in many circumstances, PPS and PEEK emit a generally metallic-sounding acoustic response when impacted. As such, by using a PPS or PEEK polymer, the present design can leverage the strength/weight benefits of the polymer, while not compromising the desirable metallic club head sound at impact.

With continued reference to FIG. 3, the present design utilizes a mixed material sole construction to leverage the strength to weight ratio benefits of FRCs, while also leveraging the design flexibility and dimensional stability/consistency offered by FTs. More specifically, while FRCs are typically stronger and less dense than FTs of the same polymer, their strength is typically contingent upon a smooth and continuous geometry. Conversely, while FTs are marginally more dense than FRCs, they can form significantly more complex geometries and are generally stronger than FRCs in intricate or discontinuous designs. These differences are largely attributable to the FRCs heavy reliance on continuous fibers to provide strength, whereas FTs rely more heavily on the structure of polymer itself.

As such, to maximize the strength of the present design at the lowest possible structural weight, the present design utilizes an FRC material to form large portions of the resilient outer shell of the sole 20, while using an FT material to locally enhance design flexibility and/or strength. More specifically, the FT material is used to: provide optimized selective structural reinforcement (i.e., where voids/apertures would otherwise compromise the strength of an FRC); affix one or more metallic swing weights 40 (i.e., where the FT more readily facilitates the attachment of discretionary metallic swingweights by molding complex receiving cavities or over-molding aspects of the weight); and/or provide a dimensionally consistent joint structure that facilitates a structural attachment between the crown member 50 and the sole member 52 while providing a continuous club head outer surface.

Figure 4:
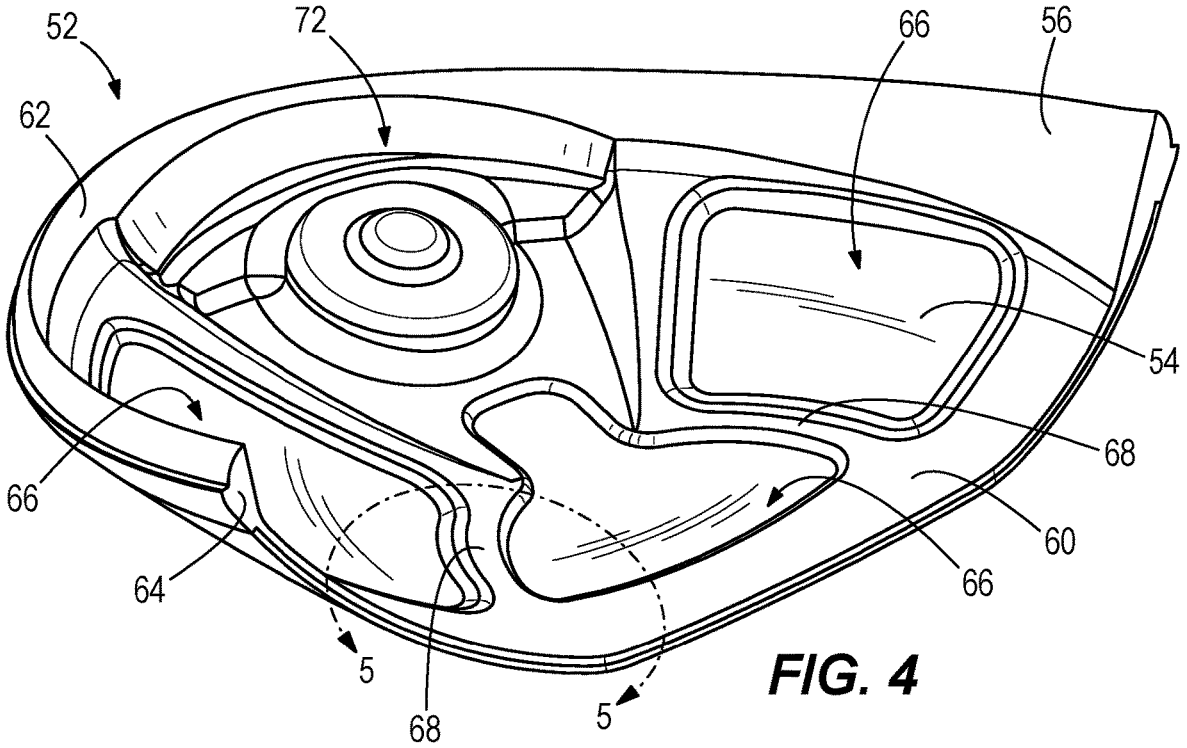
FIG. 4 is a schematic perspective view of a sole member of a mixed-material golf club head.

FIG. 4 more clearly illustrates an embodiment of the sole member 52, with an FRC resilient layer 54 bonded to a FT structural layer 56. As shown, the structural layer 56 may generally include a forward portion 60 and a rear peripheral portion 62 that define an outer perimeter 64 of the sole member 52. In an assembled club head 10, the forward portion 60 is bonded to the metallic front body 14, and the rear peripheral portion 62 is bonded to the crown member 50. The structural layer 52 defines a plurality of apertures 66 located interior to the perimeter 64 that each extend through the thickness of the layer 50. Finally, the structural layer 52 may include one or more structural members 68 that extend from the forward portion 60 and between at least two of the plurality of apertures 66.

Figure 5:
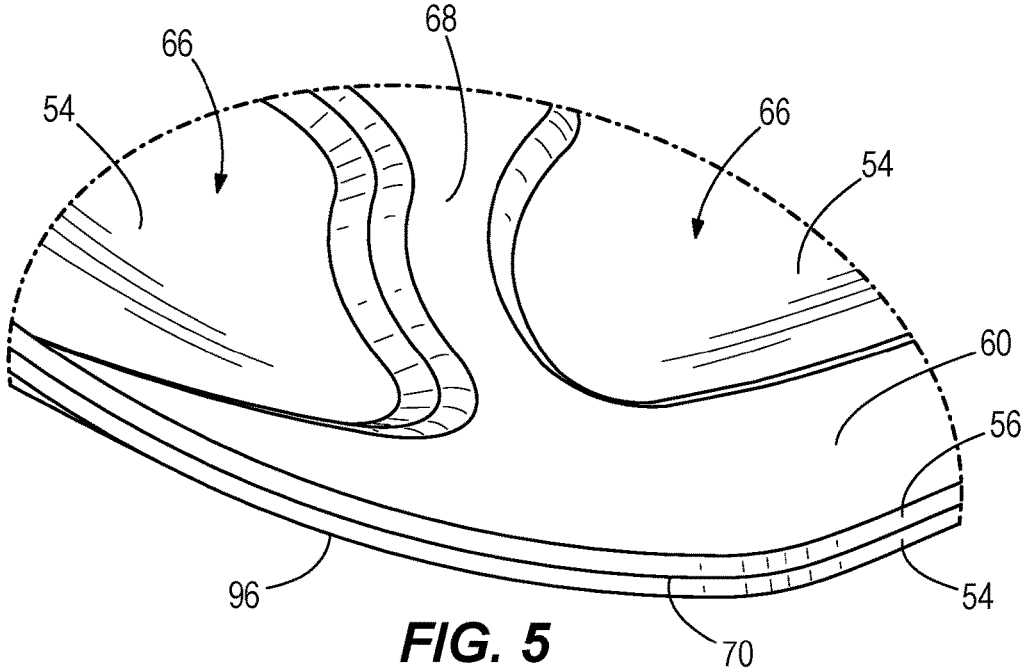
FIG. 5 is a schematic enlarged sectional view of a portion of the sole member of FIG. 4, taken along section 5-5.
Figure 6:
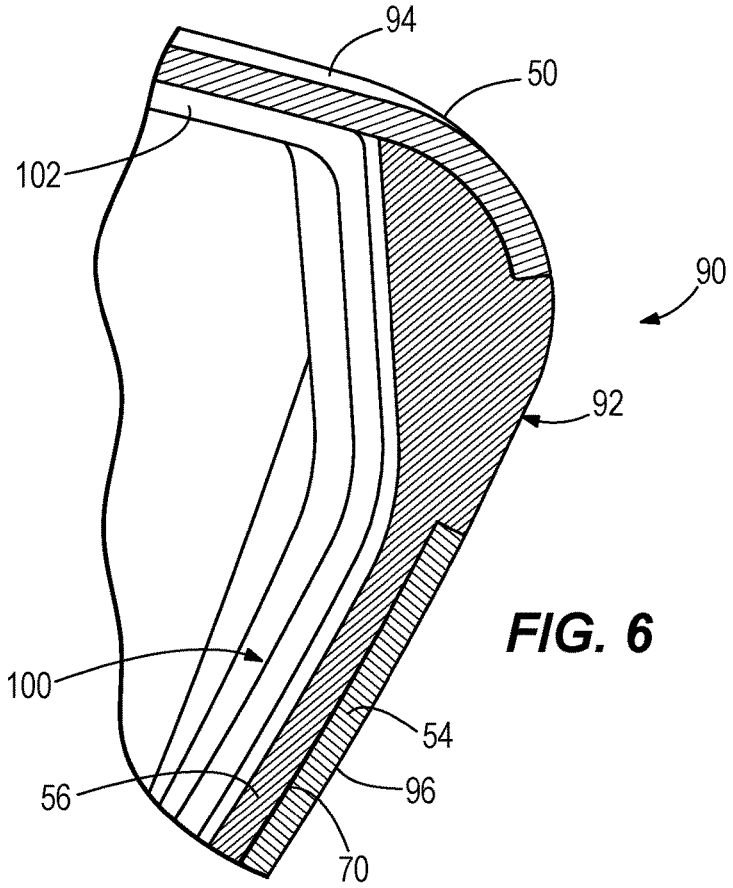
FIG. 6 is a schematic partial cross-sectional view of a joint structure of the golf club head of FIG. 2, taken along line 6-6.
Figure 7:
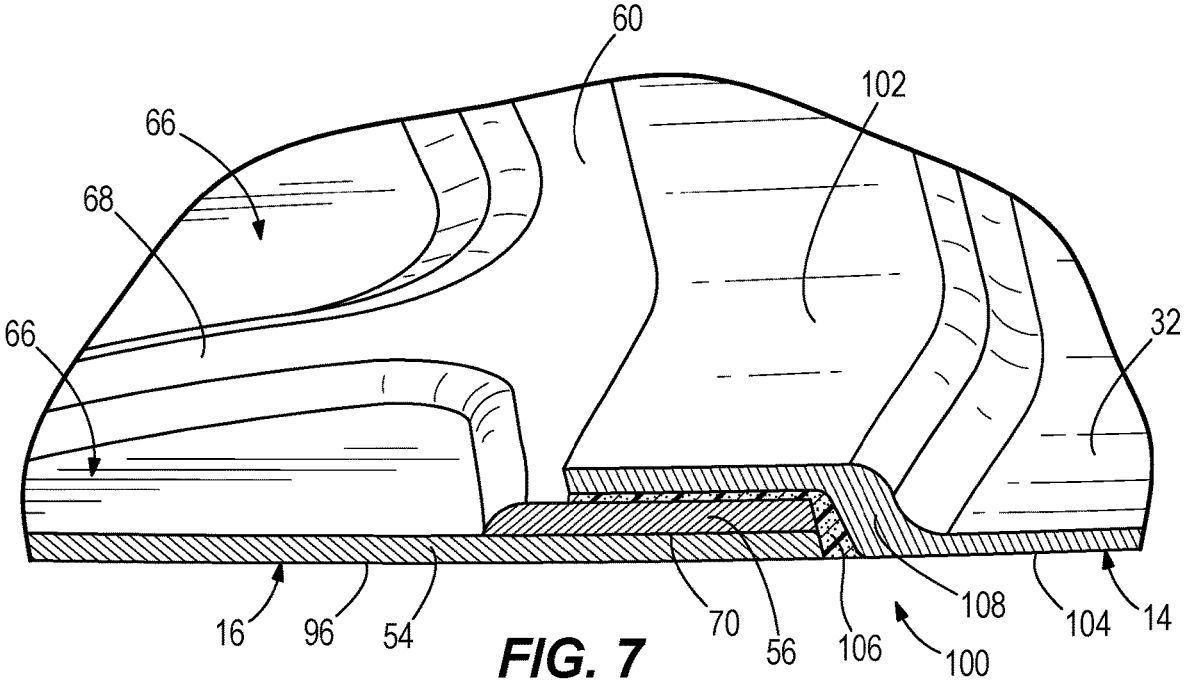
FIG. 7 is a schematic partial cross-sectional view of a joint structure of the golf club head of FIG. 2, taken along line 7-7.

As shown in FIG. 4, and more clearly in FIGS. 5-7, the resilient layer 54 may be bonded to an external surface 70 of the structural layer 56 such that it directly abuts and/or overlaps at least a portion of the forward portion 60, the rear peripheral portion 62, and the one or more structural members 68. In doing so, the resilient layer 54 may entirely cover each of the plurality of apertures 66 when viewed from the exterior of the club head 10. Likewise, the one or more structural members 68 may serve as selective reinforcement to an interior portion of the resilient layer 54, akin to a reinforcing rib or gusset.

Figure 2:
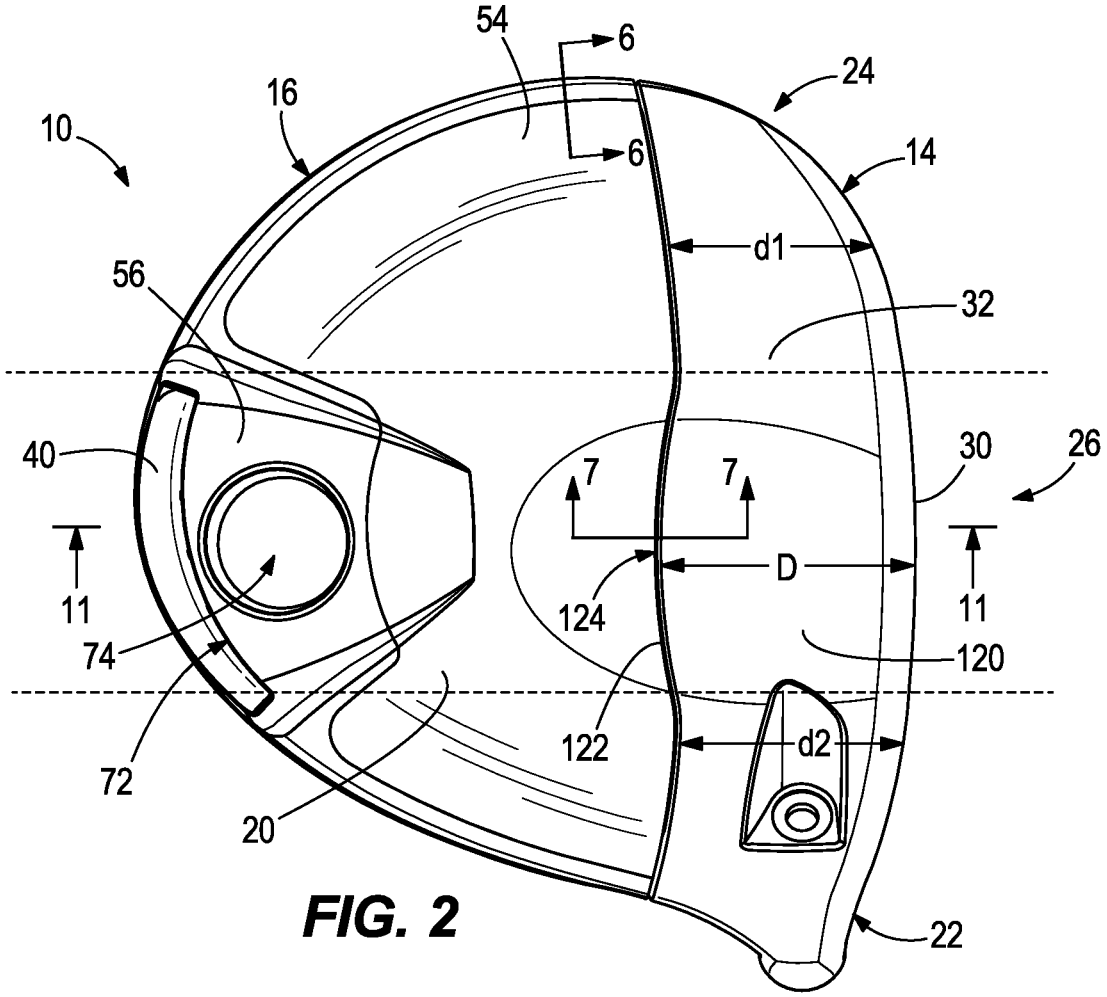
FIG. 2 is a schematic bottom view of a mixed-material golf club head.

With reference to FIGS. 2-4, in some embodiments, the structural layer 56 may include a weighted portion 72 that is adapted to receive the one or more metallic weights 40 (e.g., tungsten-based swing weights) either by directly adhering or embedding the weight into a molded cavity, or by providing a recess 74 that is operative to receive a removable metallic mass. The weighted portion 72 is generally located toward the rear most point on the club head 10, and therefore may be integral to and/or directly coupled with the rear peripheral portion 62 of the structural layer 56, and spaced apart from the forward portion 60. As noted above, the filled thermoplastic construction of the structural layer 56 is particularly suited to receive the one or more weights 40 due to its ability to form complex geometry in a structurally stable manner. More specifically, the filled thermoplastic construction of the structural layer 56 allows the design to include one or more dimensional recesses that would generally not be possible with an all-FRC construction (i.e., as the strength benefits of FRCs are typically only available across continuous surface geometries). For example, as shown in FIG. 3, and more clearly in the cross-sectional view of FIG. 11, the weighted portion 72 may be molded to define one or more weight-receiving channels or recesses that have non-uniform thicknesses, that extend around corners, and/or that join with other surfaces at sharp angles; all of which would be difficult or impossible to form strictly with a fiber reinforced composite.

While affixing the one or more weights 40 to the structural layer 56 at a rear portion of the club head 10 desirably shifts the center of gravity of the club head 10 rearward and lower while also increasing the club head's moment of inertia, it also can create a cantilevered point mass spaced apart from the more structural metallic front body 14. As such, in some embodiments, the one or more structural members 68 may span between the weighted portion 72 and the forward portion 60 to provide a reinforced load path between the one or more weights 40 and the metallic front body 14. In this manner, the one or more stiffening members 68 may be operative to aid in transferring a dynamic load between the weighted portion 72 and the front body 14 during an impact between the strike face 30 and a golf ball. At the same time, these same rib-like stiffening members 68 may be operative to reinforce the resilient layer 54 and increase the modal frequencies of the club head at impact such that the natural frequency is greater than about 3,500 Hz at impact, and exists without substantial dampening by the polymer. When this surface reinforcement is combined with the desirable metallic-like acoustic impact properties of polymers such as PPS or PEEK, a user may find the club head 10 to be audibly similar from an all-metal club head while the design provides significantly improved mass properties (CG location and/or moments of inertia).

In a preferred embodiment, the resilient layer 54 and the structural layer 56 may be integrally bonded to each other without the use of an intermediate adhesive. Such a construction may simplify manufacturing, reduce concerns about component tolerance, and provide a superior bond between the constituent layers than could be accomplished via an adhesive or other joining methods. To accomplish the integral bond, each of the resilient layer 54 and structural layer 56 may include a compatible thermoplastic polymer that may be thermally bonded to the polymer of the mating layer.

Figure 8:
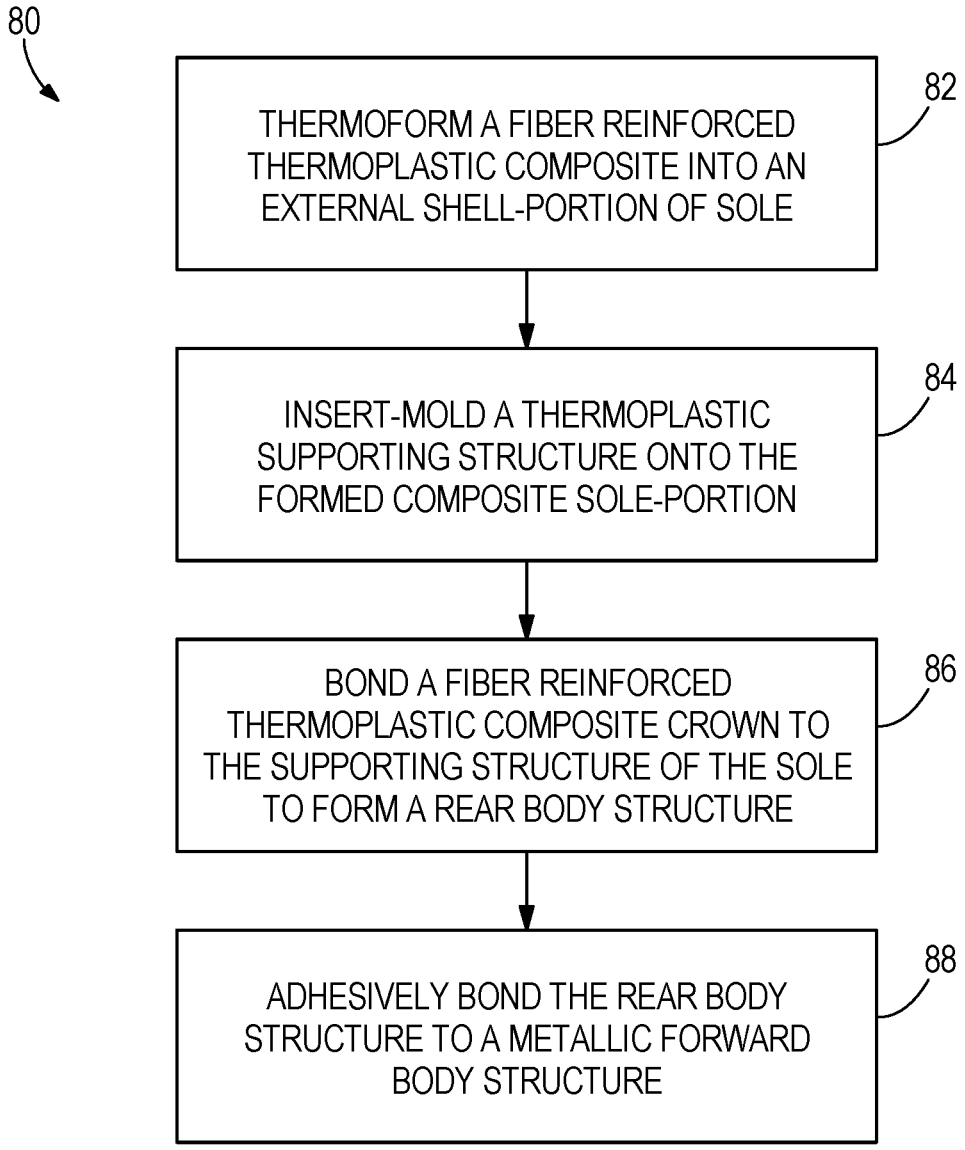
FIG. 8 is a schematic flow chart illustrating a method of manufacturing a mixed material golf club head.

FIG. 8 illustrates an embodiment of a method 80 for manufacturing a golf club head 10 having the integrally bonded resilient layer 54 and structural layer 56 of the sole member 52. The method 80 involves thermoforming a fiber reinforced thermoplastic composite into an external shell portion of the club head 10 at step 82. The thermoforming process may involve, for example, pre-heating a thermoplastic prepreg to a molding temperature at least above the glass transition temperature of the thermoplastic polymer, molding the prepreg into the shape of the shell portion, and then trimming the molded part to size.

Once the composite shell portion is in a proper shape, a filled polymeric supporting structure may then be injection molded into direct contact with the shell at step 84. Such a process is generally referred to as insert-molding. In this process, the shell is directly placed within a heated mold having a gated cavity exposed to a portion of the shell. Molten polymer is forcibly injected into the cavity, and thereafter either directly mixes with molten polymer of the heated composite shell, or locally bonds with the softened shell. As the mold is cooled, the polymer of the composite shell and supporting structure harden together in a fused relationship. The bonding is enhanced if the polymer of the shell portion and the polymer of the supporting structure are compatible, and is even further enhanced if the two components include a common thermoplastic resin component. While insert-molding is a preferred technique for forming the structure, other molding techniques, such as compression molding, may also be used.

With continued reference to FIG. 8, once the sole member 52 is formed through steps 82 and 84, an FRC crown member 50 may be bonded to the sole member 52 to substantially complete the structure of the rear body 16 (step 86). In a preferred embodiment, the crown member 50 may be formed from a thermoplastic FRC material that is formed into shape using a similar thermoforming technique as described with respect to step 82. Forming the crown member 50 from a thermoplastic composite allows the crown member 50 to be bonded to the sole member 52 using a localized welding technique. Such welding techniques may include, for example, laser welding, ultrasonic welding, or potentially electrical resistance welding if the polymers are electrically conductive. If the crown member 50 is instead formed using a thermoset polymer, then the crown member 50 may be bonded to the sole member 52 using, for example, an adhesive or a mechanical affixment technique (studs, screws, posts, mechanical interference engagement, etc).

FIG. 6 generally illustrates an embodiment of a joint 90 that is operative to couple the crown member 50 and sole member 52. As shown, the structural layer 56 separately receives the resilient layer 54 and crown member 50 to form a continuous external surface 92 (i.e., the external surface 92 of the rear body 16 comprises an external surface 94 of the crown member 50, an external surface 70 of the structural layer 56, and an external surface 96 of the resilient layer 54).

Referring again to FIG. 8, the rear body 16, comprising the affixed crown member 50 and sole member 52 may subsequently be adhesively bonded to the metallic front body structure 14 at step 88. While adhesives readily bond to most metals, the process of adhering to the polymer may require the use of one or more adhesion promoters or surface treatments to enhance bonding between the adhesive and the polymer of the rear body 16.

FIG. 7 schematically illustrates an example of a bond interface 100 between the sole member 52 and the frame 32 of the front body 14. As shown, the bond interface 100 resembles a lap joint where the structural layer 56 and/or resilient layer 54 overlay a bonding flange 102 that is inwardly recessed from an external surface 104 of the frame 32. In the illustrated embodiment, the structural layer 56 may be adhesively bonded directly to the bonding flange 102 via an intermediately disposed adhesive 106. Furthermore, the resilient layer 54 may extend over the entire forward portion 60 of the structural layer 56 such that the external surface 96 of the resilient layer 54 is flush with the external surface 104 of the frame 32. By recessing the bonding flange 102 in the manner shown, the structural layer 56 and/or resilient layer 54 may directly abut an extension wall 108 joining the frame 32 and flange 102 to further facilitate the transfer of dynamic impact loads from the weight 40/weighted portion 72 to the frame 32.

In some embodiments, the resilient layer 54 may have a substantially uniform thickness that may be in the range of from about 0.5 mm to about 0.7 mm, from about 0.5 mm to about 1.0 mm, or from about 0.6 mm to about 0.9 mm, or from about 0.7 mm to about 0.8 mm. In some embodiments, the resilient layer 54 may have a substantially uniform thickness of 0.5 mm, 0.55 mm, 0.60 mm, 0.65 mm, or 0.70 mm. In areas of the structural layer 56 that directly abut the resilient layer 54 (i.e., areas where the resilient layer 54 is located exterior to the structural layer 56), some embodiments of the structural layer 56 may have a substantially uniform thickness of from about 0.5 mm to about 0.7 mm, from about 0.5 mm to about 1.0 mm, or from about 0.6 mm to about 0.9 mm, or from about 0.7 mm to about 0.8 mm. In some embodiments, the structural layer 56 may have a substantially uniform thickness of 0.5 mm, 0.55 mm, 0.60 mm, 0.65 mm, or 0.70 mm. A substantially uniform construction of both the resilient layer 54 and the structural layer 56 is generally illustrated in FIGS. 4-7 and 11. In these embodiments, the total thickness of the resilient layer 54 and the structural layer 56 may be, for example, in the range of from about 1.0 mm to about 1.5 mm, from about 1.0 mm to about 2.0 mm, or from about 1.25 mm to about 1.75 mm, or from about 1.4 mm to about 1.6 mm. In some embodiments, the total thickness of the resilient layer 54 and the structural layer 56 may be 1.0 mm, 1.1 mm, 1.2 mm, 1.3 mm, 1.4 mm, or 1.5 mm.

Referring again to FIGS. 3 and 6, in an embodiment, the recessed bonding flange 102 may entirely encircle the strike face 30 and/or extend from the frame 32 across all portions of the crown 18 and sole 20. In this manner, as shown in FIG. 6, the rear body 16 may further be adhesively bonded to the front body 14 by adhering the crown member 50 to the bonding flange 102.

Figure 9:
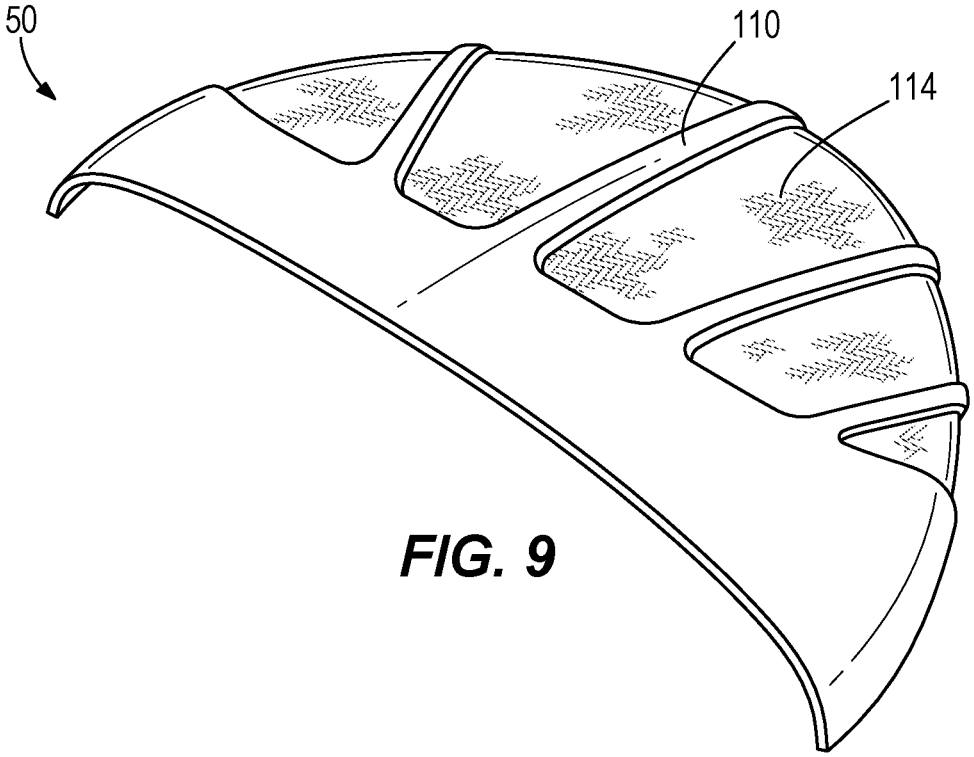
FIG. 9 is a schematic top perspective view of a mixed material crown member.
Figure 10:
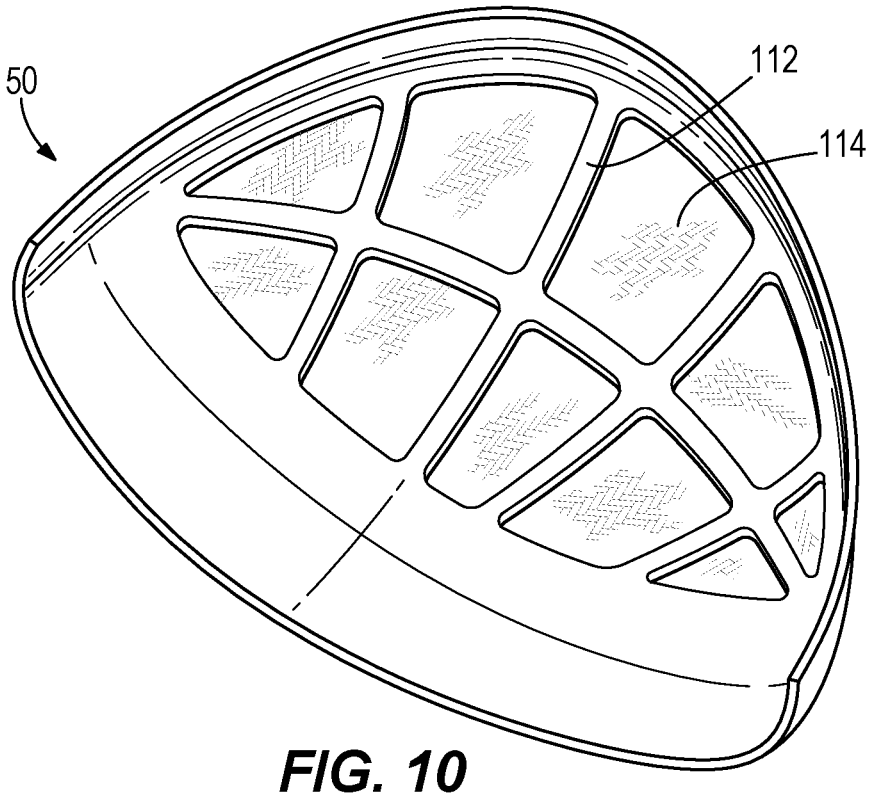
FIG. 10 is a schematic bottom perspective view of a mixed material crown member.

While the method 80 illustrated in FIG. 8 is primarily focused with forming a club head similar to that shown in FIG. 3 (i.e., where step 82 forms the resilient layer 54 of the sole member 52 and step 84 forms the structural layer 56 of the sole member 52), the processes described with respect to steps 82 and 84 may also (or alternatively) be used to form a crown member 50. For example, as shown in FIGS. 9 and 10, the crown member 50 may include one or both of an outer structural layer 110 and an inner structural layer 112 bonded to a thermoplastic FRC resilient crown layer 114. While the inner structural layer 112 may generally function in a similar manner as the structural layer 56 of the sole member 52, the outer structural layer 110 may provide further weight saving benefits by concentrating reinforcing structure in areas where it provides the most structural benefit while also enabling thinner component thicknesses at interstitial spaces. In general, the present concept of structural ribbing generally results in the creation of weight reduction zones between the ribbing. These weight reduction zones can be in the sole or the crown, and are further described in U.S. Pat. Nos. 7,361,100 and 7,686,708, which are incorporated by reference in its entirety.

Specific to construction of a mixed-material crown member 50, and similar to that described above with respect to the sole member 52, the formation may begin by thermoforming a fiber reinforced thermoplastic composite into an external shell portion of the club head 10. The thermoforming process may involve, for example, pre-heating a thermoplastic prepreg to a molding temperature at least above the glass transition temperature of the thermoplastic polymer, molding the prepreg into the shape of the shell portion, and then trimming the molded part to size.

Once the composite shell portion is in a proper shape, a filled polymeric supporting structure (i.e., one or both of the inner structural layer 112 and outer structural layer 114) may then be injection molded into direct contact with the shell (e.g., via insert-molding, as described above).

Additional aerodynamic features 116, such as turbulators, illustrated in FIG. 1 can be used to reduce club head drag and increase the speed of the club. These aerodynamic features 116 are further described in U.S. Pat. No. 9,555,294 (the '294 Patent), which is incorporated by reference in its entirety.

Referring to FIG. 2, the frame 32 may define a forward sole portion 120 that directly abuts the strike face 30. The forward sole portion 120 may terminate at a rearward edge 122 that mates with the rear body 16. In some embodiments, this rearward edge 122 may define a rearwardly protruding section 124 within the central region 26 that has a generally convex shape and extends an average distance D from the strike face 30 that is greater than both a first average distance d1 between the rearward edge 122 and the strike face 30 in the toe region 24 and a second average distance d2 between the rearward edge 122 and the strike face 30 in the heel region 22. In some configurations, the convex shape may be defined by a radius of curvature in the range of from about 25 mm to about 125 mm and an arc length in the range of from about 12 mm to about 50 mm. The rearwardly protruding section 124 generally bounds the region of the sole 20 that is under the highest stress and exhibits the highest deflection in an all-metal club head (not shown) of identical size and shape compared to the illustrative embodiment. The rear edge 122 of protruding section 124 corresponds essentially to a nodal line of the first vibration mode of the club head sole 20 which, therefore, experiences little or no deflection during impact.

Construction of the forward sole portion 120 with the illustrated geometry ensures that the portions of the sole 20 with the highest stress concentration are formed from metal. This has the practical effect of enabling a thinner, lighter rear body 16 sole member 52 due to the need for less structural reinforcement, while also maintaining a desirable dominant natural frequency at impact of at least 3,500 Hz without substantial dampening by the polymer. Similar geometry may be provided on the crown 18 of the club head 10, as described in U.S. Pat. No. 7,601,078, which is incorporated by reference in its entirety.

Utilizing a mixed material rear body construction can provide a significant reduction in structural weight while not sacrificing any design flexibility, and providing a robust means for reintroducing discretionary mass. While such a design may be formed entirely from a filled thermoplastic, such as polyphenylene sulfide (PPS), as discussed above, the use of a fiber reinforced composite provides a stronger and lighter construction across continuous outer surfaces. Conversely, an all-FRC design would not readily incorporate weight-receiving structures, and thus would not be able to easily capitalize on increased discretionary mass.

Table 1 provides comparative mass estimates for the rear body 16 design shown in FIG. 3 between an all filled PPS construction and the mixed material design described above. As shown, the mixed material design contributes to a significant weight savings over an all filled PPS construction, which can then be reintroduced into the weighted portion 72 to effect an additional translation of the center of mass down and back to increase forgiveness and dynamic loft.

TABLE 1

Mass comparison of rear body all PPS and mixed FRC/FT construction

| | Crown Member | Sole Member | Combined |
|---|---|---|---|
| All Filled PPS | 11.1 g | 33.2 g | 44.3 g |
| Mixed Material | 9.8 g | 28.0 g | 37.8 g |

If all the recovered mass is relocated to the rear weighted portion of the sole member 52, then the Mixed Material design may result in a net translation of the center of gravity (for a club head with a 205 g total mass) by approximately 0.008 mm lower, and 0.058 mm rearward when compared to an all filled PPS construction.

Table 2 illustrates the effect that the present, mixed-material construction may have on the club head moment of inertia for a club head with a 205 g total mass. Specifically, Table 2 compares the club head moments of inertia about a vertical axis ($I_{YY}$) and about a horizontal axis extending from the heel to the toe ($I_{XX}$) for a metal reference design having a similar exterior shape, for a club head with an all PPS sole member construction, and for a club head with the above-described mixed-material sole member construction.

TABLE 2

Moment of Inertia comparison of reference metal, all PPS sole member and mixed FRC/FT sole member

| | $I_{XX}$ (g-cm$^2$) | $I_{YY}$ (g-cm$^2$) |
|---|---|---|
| Metal | 3252 | 5407 |
| All Filled PPS | 4031 | 5580 |
| Mixed Material | 4286 | 5767 |

As shown in Table 2, the present mixed material design may result in about a 6.3% increase in $I_{XX}$ over the all filled PPS sole member club head, and about a 31.8% increase in $I_{XX}$ over the reference metal design. Likewise, the present mixed material design may result in about a 3.3% increase in $I_{YY}$ over the all filled PPS sole member club head, and about a 6.6% increase in $I_{YY}$ over the reference metal design. In this manner, the present mixed-material construction results in a club head that is significantly more stable during off-center impacts than either an all-PPS sole member construction or the reference metal design. Furthermore, the mixed-material design results in an increase in 2.5-3.0× increase in sole strength/resiliency when compared with an all filled-PPS construction, and present about 90%-98% of the strength/resiliency of the all-metal reference design.

Again, as noted above, these stability benefits are generated without sacrificing the sound quality of the impact. Specifically, the use of PPS or PEEK thermoplastic resins may provide certain acoustic advantages that are not possible with other polymers. Specifically, PPS and PEEK have particularly metallic acoustic properties when impacted. As such, use of these polymers in the present construction may enable the assembled golf club head 10 to acoustically respond closer to that of an all-metal design. While polyamides and some thermoplastic polyurethane materials may have sufficient strength to be suitable in the current design, their use may provide a substantially different acoustic response.

Figure 11:
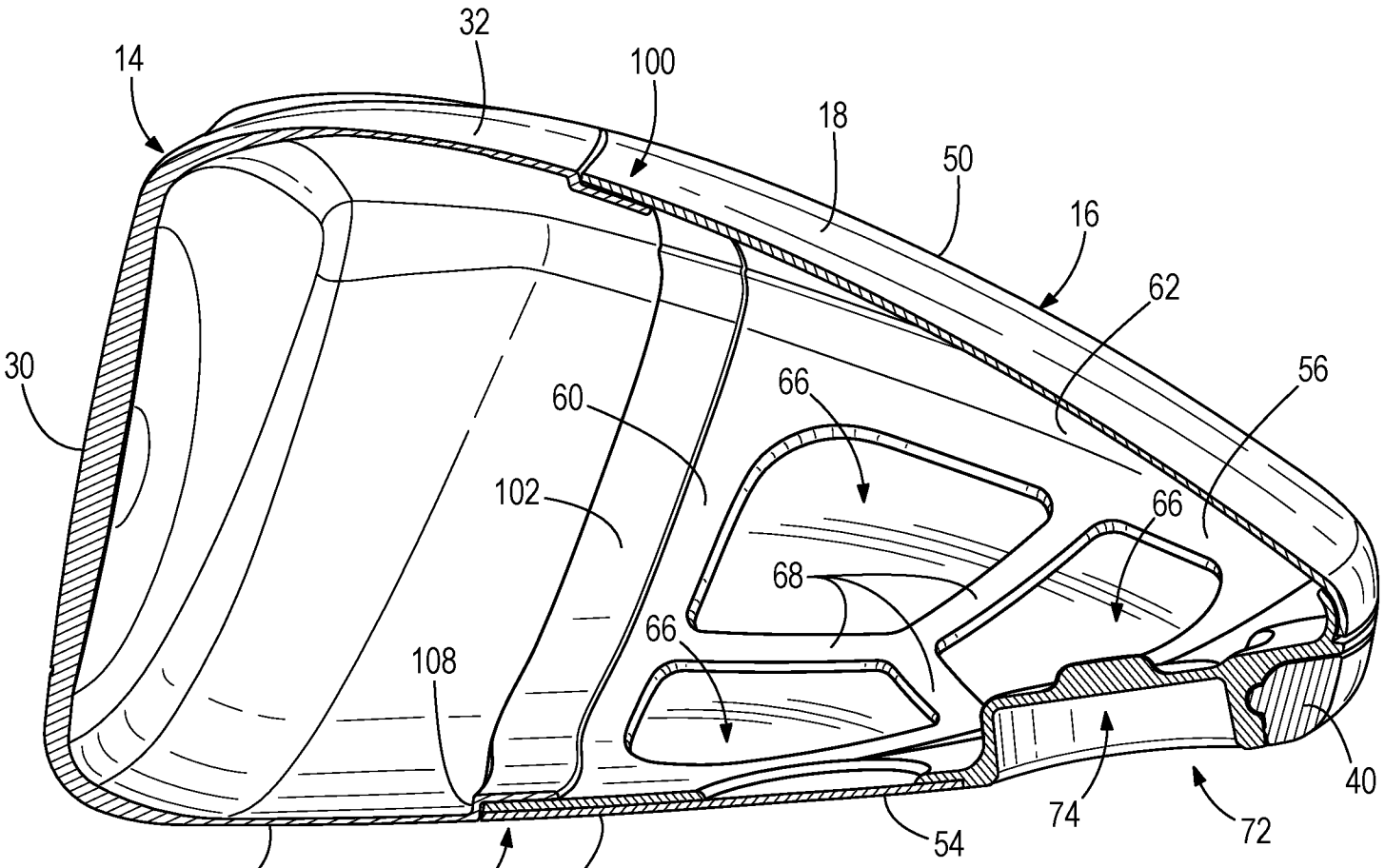
FIG. 11 is a schematic cross-sectional side view of an embodiment of a mixed material golf club head such as may be taken along line 11-11 of FIG. 2.
Figure 12:
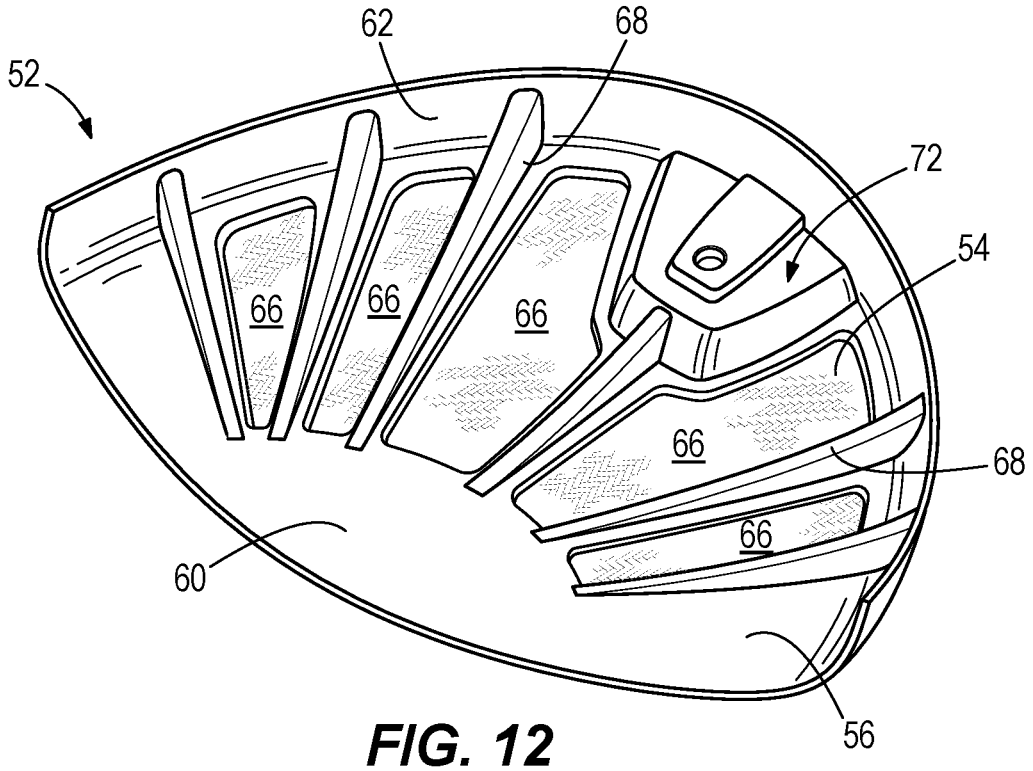
FIG. 12 is a schematic top perspective view of an embodiment of a mixed material sole member.
Figure 13:
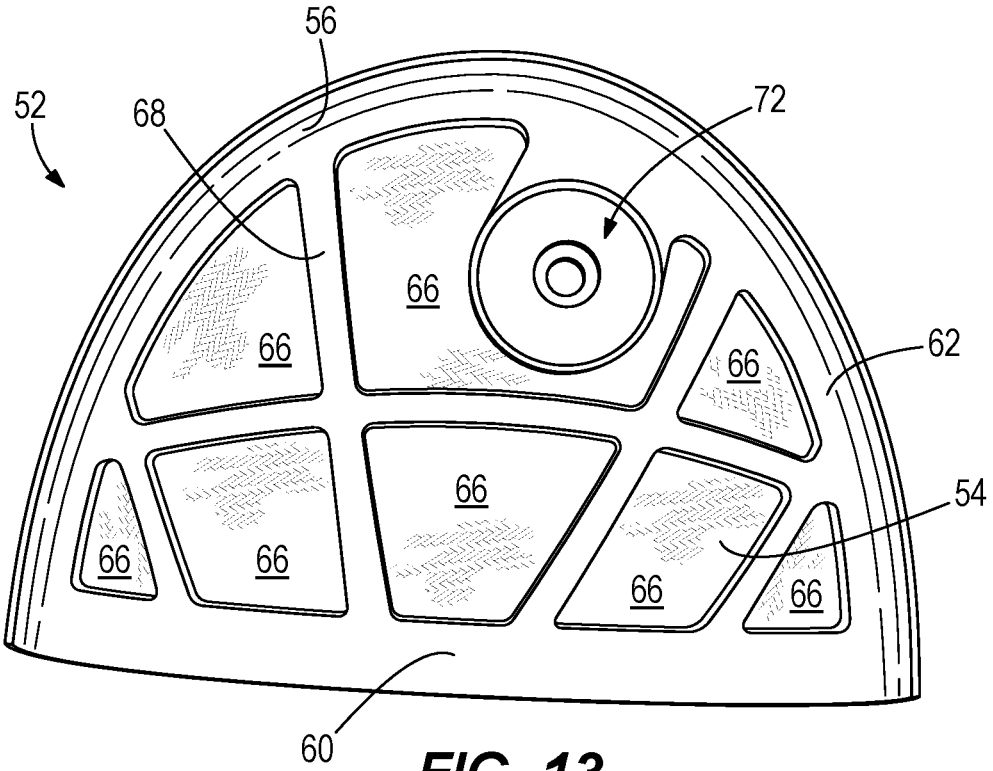
FIG. 13 is a schematic top perspective view of an embodiment of a mixed material sole member.

FIGS. 11-13 illustrate alternate sole member designs that may similarly be used in the present golf club head construction. For example, FIG. 11 illustrates an embodiment where at least one of the plurality of stiffening members 68 extends to the rear peripheral portion 62 separate from the weighted portion 72. In this embodiment, the stiffening member 68 may resemble a "Y" that extends between the forward portion 60, the weighted portion 72, and the rear peripheral portion 62 separate from the weighted portion 72. This design may further leverage the stiffened "skirt" (i.e., the reinforced band of material where the crown 18 meets the sole 20) to operatively stiffen the sole and to provide an additional load path from the weighted portion 72.

FIG. 12 illustrates an embodiment of the sole member 52 where a plurality of the stiffening members 68 extend directly from the forward portion 60 of the structural layer 56 to the rear peripheral portion 62 separate from the weighted portion 72. One stiffening member 68, however remains directly extending between the weighted portion 72 and forward portion. Additionally, FIG. 12 schematically illustrates an embodiment where the structural layer 56 may have a non-uniform/non-sheet-like geometry. Such a configuration for at least the stiffening member 68 may similarly be used with any of the previously illustrated embodiments. In an embodiment with a non-uniform structural layer, such as generally shown in FIG. 12, some constructions may still provide the resilient layer 54 with a substantially uniform thickness attributable to the nature of the fiber reinforced composite. This thickness may, for example, be in the range of from about 0.5 mm to about 1.0 mm, or from about 0.6 mm to about 0.9 mm, or even from about 0.7 mm to about 0.8 mm. Finally, FIG. 13 illustrates an embodiment where the weighted portion 72 is supported by only the rear peripheral portion 62, with no structural member 68 being connected thereto.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosures are set forth in the following clauses.

Clause 1: A golf club head comprising a metallic front body including a strike face and a surrounding frame that extends rearward from a perimeter of the strike face; a rear body coupled to the metallic front body to define a substantially hollow structure, the rear body including a crown member and a sole member coupled to the crown member, the sole member comprising: a structural layer formed from a filled thermoplastic material and bonded to the crown member, the structural layer including a plurality of apertures extending through a thickness of the structural layer; and a resilient layer bonded to an external surface of the structural layer such that the resilient layer extends across each of the plurality of apertures, wherein the resilient layer is formed from a fiber-reinforced thermoplastic composite material; wherein the structural layer and the resilient layer each comprise a common thermoplastic resin component, and wherein the structural layer is directly bonded to the resilient layer without an intermediate adhesive.

Clause 2: The golf club head of clause 1, wherein the structural layer further includes: a forward portion in contact with, and bonded to the metallic front body; a weighted portion spaced apart from the forward portion; a structural member extending from the forward portion to the weighted portion and between at least two of the plurality of apertures, the structural member integrally molded with both the forward portion and the weighted portion; and the sole member further including a metallic weight at least partially embedded in, or adhesively bonded to the weighted portion of the structural layer.

Clause 3: The golf club head of any of clauses 1-2, wherein an external surface of the rear body comprises an external surface of the crown member, an external surface of the resilient layer, and a portion of the external surface of the structural layer.

Clause 4: The golf club head of any of clauses 1-3, wherein the metallic front body further includes a bonding flange that is inwardly recessed from an external surface of the frame; wherein the structural layer is adhesively bonded to the bonding flange; and wherein an external surface of the resilient layer is flush with the external surface of the frame.

Clause 5: The golf club head of clause 4, wherein the metallic front body further includes an extension wall that couples the frame to the bond flange; wherein the structural layer and resilient layer each abut the extension wall; and wherein the stiffening member is operative to transfer a dynamic load between the weighted portion and the extension wall during an impact between the strike face and a golf ball.

Clause 6: The golf club head of any of clauses 1-5, wherein the common thermoplastic resin component comprises polyphenylene sulfide or polyether ether ketone.

Clause 7: The golf club head of any of clauses 1-6, wherein the frame includes a crown portion and a sole portion, wherein the golf club head includes a heel region, a toe region, and a central region disposed between the heel region and the toe region; wherein the sole portion of the frame defines a rearward edge that extends a first average distance from the strike face within the heel region, a second average distance from the strike face within the toe region, and a third average distance from the strike face within the central region; and wherein the third average distance is greater than both the first average distance and the second average distance.

Clause 8: A golf club head comprising: a metallic front body including a strike face and a surrounding frame that extends rearward from a perimeter of the strike face; a rear body coupled to the metallic front body to define a substantially hollow structure, the rear body including a crown member coupled with a sole member, the sole member comprising: a structural layer having: a forward portion in contact with and bonded to the metallic front body; a weighted portion spaced apart from the forward peripheral portion; a plurality of apertures extending through a thickness of the structural layer, wherein the forward portion and weighted portion are disposed on opposing sides of at least one of the plurality of apertures; and a plurality of stiffening members, each stiffening member extending from the forward portion to the weighted portion and between at least two of the plurality of apertures; a resilient layer bonded to an external surface of the structural layer such that the resilient layer abuts the metallic front body and extends across each of the plurality of apertures; a metallic weight at least partially embedded in, or adhesively bonded to the weighted portion of the structural layer; and wherein the structural layer is formed from a filled thermoplastic material, and the resilient layer is formed from a fiber-reinforced thermoplastic composite material.

Clause 9: The golf club head of clause 8, wherein the resilient layer is directly bonded to the structural layer without an intermediate adhesive.

Clause 10: The golf club head of any of clauses 8-9, wherein the structural layer further includes a rear peripheral portion extending between the weighted portion and the forward portion, wherein the rear peripheral portion is bonded to the crown member.

Clause 11: The golf club head of clause 10, wherein at least one of the plurality of stiffening members extends to the rear peripheral portion separate from the weighted portion.

Clause 12: The golf club head of any of clauses 8-11, wherein an external surface of the rear body comprises an external surface of the crown member, an external surface of the resilient layer, and a portion of the external surface of the structural layer.

Clause 13: The golf club head of any of clauses 8-12, wherein the metallic front body further includes a bonding flange that is inwardly recessed from an external surface of the frame; wherein the structural layer is adhesively bonded to the bonding flange; and wherein an external surface of the resilient layer is flush with the external surface of the frame.

Clause 14: The golf club head of clause 13, wherein the metallic front body further includes an extension wall that couples the frame to the bond flange; wherein the structural layer and resilient layer each abut the extension wall; and wherein the plurality of stiffening members are operative to transfer a dynamic load between the weighted portion and the extension wall during an impact between the strike face an a golf ball.

Clause 15: The golf club head of any of clauses 8-14, wherein the frame includes a crown portion and a sole portion, wherein the golf club head includes a heel region, a toe region, and a central region disposed between the heel region and the toe region; wherein the sole portion of the frame defines a rearward edge that extends a first average distance from the strike face within the heel region, a second average distance from the strike face within the toe region, and a third average distance from the strike face within the central region; and wherein the third average distance is greater than both the first average distance and the second average distance.

Clause 16: The golf club head of clause 15, wherein the weighted portion and a geometric center of the strike face are located within the central region.

Clause 17: The golf club head of any of clauses 8-16, wherein each of the filled thermoplastic material and fiber reinforced thermoplastic composite material includes a common resin component; and wherein the common resin component is present in the filled thermoplastic material in a first amount and is present in the fiber reinforced thermoplastic composite material in a second amount that is less than the first amount.

Clause 18: The golf club head of clause 17, wherein the common resin component comprises polyphenylene sulfide or polyether ether ketone.

Clause 19: The golf club head of any of clauses 17-18, wherein the first amount greater than about 55% by volume, and the second amount less than about 35% by volume.

Clause 20: A method of manufacturing a multi-material golf club head comprising: thermoforming a first sole layer from a fiber-reinforced composite comprising a thermoplastic resin matrix and a woven fiber reinforcement layer; injection molding a second sole layer in direct contact with the thermoformed first sole layer, wherein the second sole layer comprises a filled thermoplastic resin, and wherein the thermoplastic resin matrix and the filled thermoplastic resin each comprise a common thermoplastic polymer; bonding a crown member to the second sole layer; and bonding the first sole layer and the crown member to a metallic forward body to define a substantially hollow structure, and wherein the metallic forward body includes a strike face and a hosel.

Clause 21: The method of clause 21, wherein bonding a crown member to the second sole layer includes welding the crown member to the second sole layer through at least one of laser welding, ultrasonic welding, or electrical resistance welding.

Clause 22: The method of any of clauses 20-21, further comprising forming the crown member by thermoforming a first crown layer from a fiber-reinforced composite comprising a thermoplastic resin matrix and a woven fiber reinforcement layer; injection molding a second crown layer in direct contact with the thermoformed first crown layer, wherein the second crown layer comprises a filled thermoplastic resin, and wherein the thermoplastic resin matrix and the filled thermoplastic resin each comprise a common thermoplastic polymer Clause 23: A golf club head comprising a metallic front body including a strike face and a surrounding frame that extends rearward from a perimeter of the strike face; a rear body coupled to the metallic front body to define a substantially hollow structure, the rear body including a crown member and a sole member coupled to the crown member, the crown member comprising: a structural layer formed from a filled thermoplastic material and bonded to the sole member, the structural layer including a plurality of apertures extending through a thickness of the structural layer; and a resilient layer bonded to the structural layer such that the resilient layer extends across each of the plurality of apertures, wherein the resilient layer is formed from a fiber-reinforced thermoplastic composite material; wherein the structural layer and the resilient layer each comprise a common thermoplastic resin component, and wherein the structural layer is directly bonded to the resilient layer without an intermediate adhesive.

The invention claimed is:

1. A golf club head comprising:

a metallic front body including a strike face and a surrounding frame that extends rearward from a perimeter of the strike face;

a rear body coupled to the metallic front body to define a substantially hollow structure, the rear body including a crown member and a sole member coupled to the crown member, wherein the crown member and the sole member comprise:

a structural layer formed from a filled thermoplastic material, the structural layer including a plurality of apertures extending through a thickness of the structural layer; and a resilient layer bonded to an external surface of the structural layer such that the resilient layer extends across each of the plurality of apertures, wherein the resilient layer is formed from a fiber-reinforced thermoplastic composite material;

wherein the structural layer and the resilient layer each comprise a common thermoplastic resin component, and wherein the structural layer is directly bonded to the resilient layer without an intermediate adhesive.

2. The golf club head of claim 1, wherein the structural layer of the sole member further includes:

a forward portion in contact with, and bonded to the metallic front body;

a weighted portion spaced apart from the forward portion;

a structural member extending from the forward portion to the weighted portion and between at least two of the plurality of apertures, the structural member integrally molded with both the forward portion and the weighted portion; and the sole member further including a metallic weight at least partially embedded in, or adhesively bonded to the weighted portion of the structural layer.

3. The golf club head of claim 1, wherein an external surface of the rear body comprises an external surface of the crown member resilient layer and an external surface of the sole member resilient layer, and a portion of the external surface of the sole member structural layer.

4. The golf club head of claim 1, wherein the metallic front body further includes a bonding flange that is inwardly recessed from an external surface of the surrounding frame;

wherein the structural layer of the sole member is adhesively bonded to the bonding flange; and wherein an external surface of the sole member resilient layer is flush with the external surface of the surrounding frame.

5. The golf club head of claim 4, wherein the metallic front body further includes an extension wall that couples the surrounding frame to the bonding flange;

wherein the structural layer of the sole member includes a weighted portion, and a structural member extending toward the metallic front body from the weighted portion;

wherein the resilient layer and the structural layer of the sole member each abut the extension wall; and wherein the structural member is operative to transfer a dynamic load between the weighted portion and the extension wall during an impact between the strike face and a golf ball.

6. The golf club head of claim 1, wherein the metallic front body further includes a bonding flange that is inwardly recessed from an external surface of the surrounding frame;

wherein the structural layer of the crown member is adhesively bonded to the bonding flange; and wherein an external surface of the crown member resilient layer is flush with the external surface of the surrounding frame.

7. The golf club head of claim 1, wherein the common thermoplastic resin component comprises a polyphenylene sulfide or a polyether ether ketone.

8. The golf club head of claim 1, wherein the surrounding frame includes a crown portion and a sole portion, wherein the golf club head includes a heel region, a toe region, and a central region disposed between the heel region and the toe region;

wherein the sole portion of the surrounding frame defines a rearward edge that extends a first average distance from the strike face within the heel region, a second average distance from the strike face within the toe region, and a third average distance from the strike face within the central region; and wherein the third average distance is greater than both the first average distance and the second average distance.

9. The golf club head of claim 1, wherein the structural layer of at least one of the crown member and the sole member further comprises a forward portion in contact with and bonded to the metallic front body, and a plurality of stiffening members, wherein each stiffening member extends from the forward portion and between at least two the plurality of apertures.

10. A golf club head comprising:

a metallic front body including a strike face and a surrounding frame that extends rearward from a perimeter of the strike face;

a rear body coupled to the metallic front body to define a substantially hollow structure, the rear body including a crown member coupled with a sole member, wherein the crown member and the sole member comprise:

a structural layer having:

a forward portion in contact with and bonded to the metallic front body;

a plurality of apertures extending through a thickness of the structural layer; and a plurality of stiffening members, each stiffening member extending from the forward portion and between at least two of the plurality of apertures;

a resilient layer bonded to an external surface of the structural layer without an intermediate adhesive such that the resilient layer abuts the metallic front body and extends across each of the plurality of apertures;

wherein the structural layer is formed from a first material consisting of a first plurality of fibers disposed within a first thermoplastic polymer, and the resilient layer is formed from a second material consisting of a second plurality of fibers disposed within a second thermoplastic polymer, wherein an amount of the first thermoplastic polymer, by volume, within the first material is greater than an amount of the second thermoplastic polymer, by volume, within the second material.

11. The golf club head of claim 10, wherein the first thermoplastic polymer is directly bonded to the second thermoplastic polymer.

12. The golf club head of claim 10, wherein the structural layer of the sole member further includes a rear peripheral portion, and wherein the rear peripheral portion directly joins the crown member with the sole member.

13. The golf club head of claim 12, wherein at least one of the plurality of stiffening members extends to the rear peripheral portion.

14. The golf club head of claim 10, wherein the first plurality of fibers comprises a plurality of discontinuous fibers, each having a maximum dimension of less than about 25 mm, and wherein the second plurality of fibers comprises a plurality of continuous fibers interwoven as a fabric.

15. The golf club head of claim 14, wherein the first thermoplastic polymer is the same as the second thermoplastic polymer.

16. The golf club head of claim 15, wherein the first thermoplastic polymer and the second thermoplastic polymer each comprise a polyphenylene sulfide or a polyether ether ketone.

17. The golf club head of claim 10, wherein the amount of the first thermoplastic polymer within the first material is greater than about 55% by volume, and wherein the amount of the second thermoplastic polymer within the second material is less than about 35% by volume.

18. The golf club head of claim 10, wherein the metallic front body further includes a bonding flange that is inwardly recessed from an external surface of the surrounding frame;

wherein the structural layer of the sole member is adhesively bonded to the bonding flange; and wherein an external surface of the sole member resilient layer is flush with the external surface of the surrounding frame.

19. The golf club head of claim 10, wherein the metallic front body further includes a bonding flange that is inwardly recessed from an external surface of the surrounding frame;

wherein the structural layer of the crown member is adhesively bonded to the bonding flange; and wherein an external surface of the crown member resilient layer is flush with the external surface of the surrounding frame.

20. The golf club head of claim 10, wherein the surrounding frame includes a crown portion and a sole portion, wherein the golf club head includes a heel region, a toe region, and a central region disposed between the heel region and the toe region;

wherein the sole portion of the surrounding frame defines a rearward edge that extends a first average distance from the strike face within the heel region, a second average distance from the strike face within the toe region, and a third average distance from the strike face within the central region; and wherein the third average distance is greater than both the first average distance and the second average distance.

* * * * *